US006094882A

United States Patent [19]

Pervan

[11] Patent Number: 6,094,882

[45] Date of Patent: Aug. 1, 2000

[54] METHOD AND EQUIPMENT FOR MAKING A BUILDING BOARD

[75] Inventor: Darko Pervan, Viken, Sweden

[73] Assignee: Valinge Aluminium AB, Viken, Sweden

[21] Appl. No.: 09/323,953

[22] Filed: Jun. 2, 1999

Related U.S. Application Data

[63] Continuation of application No. PCT/SE97/02034, Dec. 5, 1997.

[30] Foreign Application Priority Data

Dec. 5, 1996 [SE] Sweden ..... 9604483

[51] Int. Cl.[7] ..... E04B 5/12

[52] U.S. Cl. ..... 52/745.19; 52/480; 52/737.3; 29/897.3

[58] Field of Search ..... 52/749.19, 737.3, 52/480; 29/897.3, 897.32, 897.35

[56] References Cited

U.S. PATENT DOCUMENTS

| | | |
|---|---|---|
| 1,988,201 | 1/1935 | Hall . |
| 3,045,294 | 7/1962 | Livezey, Jr. . |
| 3,267,630 | 8/1966 | Omholt . |
| 3,310,919 | 3/1967 | Bue et al. . |
| 3,387,422 | 6/1968 | Wanzer . |
| 3,526,420 | 9/1970 | Brancaleone . |
| 3,694,983 | 10/1972 | Couquet . |
| 3,759,007 | 9/1973 | Thiele . |
| 3,859,000 | 1/1975 | Webster . |
| 4,169,688 | 10/1979 | Toshio . |

(List continued on next page.)

FOREIGN PATENT DOCUMENTS

| | | |
|---|---|---|
| 417526 | 9/1936 | Belgium . |
| 0 248 127 | 12/1987 | European Pat. Off. . |
| 843060 | 8/1984 | Finland . |
| 2630149 | 10/1989 | France . |
| 2697275 | 4/1994 | France . |
| 7102476 | 1/1971 | Germany . |
| 7402354 | 1/1974 | Germany . |
| 26 16 077 | 10/1977 | Germany . |
| 29 17 025 | 11/1980 | Germany . |
| 32 46 376 | 6/1984 | Germany . |
| 33 43 601 | 6/1985 | Germany . |
| 86 04 004 | 6/1986 | Germany . |
| 42 15 273 | 11/1993 | Germany . |
| 54-65528 | 5/1979 | Japan . |
| 57-119056 | 6/1982 | Japan . |
| 3-169967 | 7/1991 | Japan . |
| 5-148984 | 6/1993 | Japan . |
| 7601773 | 2/1976 | Netherlands . |
| 157 871 | 2/1988 | Norway . |
| 372 051 | 12/1974 | Sweden . |
| 450 141 | 6/1987 | Sweden . |
| 1127915 | 10/1965 | United Kingdom . |
| 1237744 | 6/1971 | United Kingdom . |
| 2117813 | 10/1983 | United Kingdom . |
| 2243381 | 10/1991 | United Kingdom . |
| WO84/02155 | 6/1984 | WIPO . |
| WO93/13280 | 7/1993 | WIPO . |
| WO94/26999 | 11/1994 | WIPO . |

*Primary Examiner*—Christopher T. Kent
*Attorney, Agent, or Firm*—Burns, Doane, Swecker & Mathis LLP

[57] ABSTRACT

The invention relates to a method and equipment intended therefore for making a building board 2, comprising a body 5 fitted with a locking device in the form of a strip 10 extended from the body 5 with a formed locking surface 14 for mechanical joining of the board 2 to similar boards, the strip 10 and the locking surface 14 being formed in one piece from a blank 40. The invention is characterized by carrying out the following steps A and B in optional order: A, forming the locking surface 14 against a forming surface 64 and subsequently keeping the locking surface 14 thus formed fixed in relation to the forming surface 64 until both step A and step B have been carried out, B. attaching the strip 10 to the body S and, while carrying out the latter of steps A and B, by keeping the body S fixed against a reference surface 70, whose position in relation to the forming surface 64 corresponds to a desired position of the locking surface 14 in relation to the body S.

15 Claims, 3 Drawing Sheets

U.S. PATENT DOCUMENTS

| | | | |
|---|---|---|---|
| 4,501,102 | 2/1985 | Knowles | 29/897.3 X |
| 4,641,469 | 2/1987 | Wood . | |
| 4,738,071 | 4/1988 | Ezard | 29/897.35 X |
| 4,769,963 | 9/1988 | Meyerson . | |
| 4,819,932 | 4/1989 | Trotter, Jr. . | |
| 5,029,425 | 7/1991 | Bogataj . | |
| 5,179,812 | 1/1993 | Hill . | |
| 5,295,341 | 3/1994 | Kajiwara . | |
| 5,349,796 | 9/1994 | Meyerson . | |
| 5,706,621 | 1/1998 | Pervan . | |
| 5,768,850 | 6/1998 | Chen . | |

METHOD AND EQUIPMENT FOR MAKING A BUILDING BOARD

This is a continuation of International Application No. PCT/SE97/02034, filed Dec. 5, 1997, that designates the United States of America and which claims priority from Swedish Application No. 9604483-9, filed Dec. 5, 1996.

FIELD OF THE INVENTION

The present invention relates to a method and equipment for making a building board, such as a floorboard. More specifically, the invention relates to a method and equipment for making building boards which are to be mechanically joined to each other and which, for the mechanical joining, each have a projecting metal strip which is formed with a locking element intended to engage with a complementary locking groove of an adjoining building board.

Specifically, the invention aims to provide good tolerances of the joint between two building boards joined by means of such a mechanical connection.

BACKGROUND, FEATURES AND ADVANTAGES OF THE INVENTION

A floorboard fitted with a projecting metal strip formed with a locking element for mechanical joining is described in WO 94/26999, which document is herewith incorporated by reference and to which reference is made for a more detailed description of how such building boards can be designed and joined together. The background, features and advantages of the invention will be described for this known type of floorboard, but it should be emphasised that the invention is useful for making building board types other than floorboards, such as wall panels and roof slabs.

WO 94/26999 describes a system for mechanical joining of floorboards. A first mechanical connection provides mutual vertical locking of the joint edges and may be in the form of a tongue-and-groove joint along the joint. A second mechanical connection provides mutual horizontal locking of the boards in a direction at right angles to the joint edges of the boards.

In order to illustrate the problems which form the basis of the present invention, reference is now made to FIG. 1, which shows in section a joint between two identical, mechanically joined floorboards 2. The design and function of the floorboards 2 substantially correspond to what is known from WO 94/26999. However, there are certain differences compared to the prior art with respect to the geometrical shapes of a gripping stud and a locking element. However, these differences are not primarily relevant to this description.

Each board 2 has a top side 4 and an underside 6 and, for illustration purposes, can be assumed to be made of a body S of e.g. laminated fibreboard, plastic composite, wood or the like. The thickness of the body S can, for example, be 7 mm. To enable a mechanical connection, opposite joint edges 8 of the boards 2 are formed with an integrated metal strip 10 mounted at the factory, as well as a locking groove 16. The strip 10 is preferably made of sheet aluminium and extends horizontally from the underside 6 of the board 2 in the direction of the second floorboard and runs continuously throughout the entire length of the joint. However, the strip 10 can be divided into smaller parts, which cover the main portion of the length of the joint.

In the embodiment shown by way of illustration in FIG. 1, the strip 10 is mechanically fastened to the body S in the manner described in more detail below. Mechanical fastening is preferred, but not absolutely necessary for the implementation of the present invention. As an alternative, the strip 10 can be glued or be attached to the body in some other way. However, mechanical fastening is preferred for tolerance reasons. Other sheet metal materials can be used besides sheet aluminium. In order to achieve the required joint tolerances as well as simple laying, the strip 10 is integrally formed with the board, i.e. it is mounted at the factory and should specifically not be mounted in connection with laying. As a non-restrictive example, the strip 10 may have a width of about 30 mm and a thickness of about 0.6 mm.

The strip 10 is formed with a locking element 12, bent from the sheet material, which exhibits an active locking surface 14 having a height of e.g. 1 mm. In the joined state, the locking element 12 is received in a locking groove 16, formed in the underside 6 of the second board and extending parallel to and spaced from the joint edge 8. The locking element 12 and the locking groove 16 together form the above-mentioned second mechanical connection, locking the boards 2 to each other in the direction designated D2. More specifically, the locking surface 14 of the locking element 12 serves as a stop with respect to the surface 18 of the locking groove 16 closest to the joint edges 8.

When the boards 2 are joined together according to FIG. 1, they can occupy a relative position in the direction D2 where a small play Δ, as small as 0.01 mm, exists between the locking surface 14 and the locking groove 16. This play Δ makes it possible to displace the boards 2 in the direction of the joint without the use of tools. This displaceability facilitates the laying and enables joining together the short sides by snap action. Reference is made to WO 94/26999 for a more detailed description of the function and advantages of this construction.

The strip 10 is mounted in a tolerance-equalising groove in the underside 6 of the board 2. In this embodiment, the width of the equalising groove is approximately equal to half the width of the strip 10, i.e. about 15 mm. The functioning of and different ways of forming the equalising groove are described in detail in WO 94/26999 and, consequently, need not be repeated here.

For the mechanical fastening of the strip 10 to the board S, a groove 20 is provided in the underside 6 of the board 2 spaced from a recess 22 adjacent to the joint edge B. The groove 20 may be formed either as a continuous groove extending throughout the entire length of the board 2, or as a number of separate grooves. Together with the recess 22, this groove 20 defines a dove-tail gripping stud 24. In its fastened state in FIG. 1, the strip 10 exhibits a number of punched and bent tongues 26 as well as one or more lips 28, which are bent round opposite sides of the gripping stud 24.

The present invention is based on (i) the fact known per se that a good joint of the type described above requires the locking surface 14 to have an exact, predetermined distance from the upper joint edge 8 of the floorboard 2, and (ii) an insight that there are tolerance problems (compound tolerances) which are difficult to overcome in manufacturing the board 2 and the strip 10 as well as in attaching these two components to each other.

The problem behind the invention will now he described in more detail with reference to FIG. 2 in the appended drawings, where the following positions P1–P3, distances S1–S3, and tolerances t1 and t2 are indicated on a finished floorboard 2 according to FIG. 1:

P1–P3 refer to relative positions horizontally.

P1: The upper joint edge 8 of the floorboard

P2: Reference point on the gripping stud 24

P3: Locking surface 14 of the strip 10

S1* Desired distance between P1 and P2

S1 Actual distance between P1 and P2 due to t1

±t1 Range of tolerance for S1 when milling the gripping stud 24

S2* Desired distance between P2 and P3

S2 Actual distance between P2 and P3 due to t2

±t2 Range of tolerance with respect to P2's position in relation to P3 due to inexact positioning when attaching and manufacturing a preformed strip.

S3* Desired distance between P1 and P3

S3 Actual distance between P1 and P3

With the above designations, the following applies:

$$S1=S1^*\pm t1 \quad (1)$$

$$S2=S2^*\pm t2 \quad (2)$$

$$S3=(S2^*\pm t2)-(S1^*\pm t1)=(S2^*-S1^*)\pm t1\pm t2=S3^*\pm t1\pm t2 \quad (3)$$

Two extreme cases 1 and 2 are found on the basis of these designations:

Extreme Case No. 1: S1 max & S2 min

In a first extreme case, because of inexact milling and/or wear of the milling tool, the gripping stud 24 is maximally displaced (+t1) from its nominal position in the direction away from the joint edge 8. In this case, the distance S1 assumes its maximum value S1*+t1 (P2 far from P1). The strip 10 with preformed locking element 12 is made in such a way and mounted in such a way that the locking surface 14 assumes a position P3 maximally displaced (+t2) towards the gripping stud 24. The distance S2, then assumes its minimum value S2*−t2 (P3 close to P2). In this extreme case, the two tolerances t1 and t2 contribute to the displacement of the locking surface 14 (P3) in the direction towards the upper joint edge 8 (P1). As a result, the locking surface 14 may end up being so close to the upper joint edge 8 that two boards cannot be joined together correctly, or they can become so biased that they cannot be displaced in relation to each other without the use of tools.

Extreme Case No. 2. S1 min and S2 max

In a second extreme case, because of inexact milling and/or wear of the milling tool, the gripping stud 24 is instead maximally displaced (−t1) from its nominal position in the direction towards the joint edge 8. In this case, the distance S1 assumes its minimum value S1*−t1 (P2 close to P1). The strip 10 with preformed locking element 12 is made in such a way and mounted in such a way that the locking surface 14 assumes a position P3 maximally displaced (+t2) from the gripping stud 24. The distance S2 then assumes its maximum value S2*+t2 (P3 far from P2). In this second extreme case, the two tolerances t1 and t2 instead contribute to the displacement of the locking surface 14 (P3) in the direction away from the upper joint edge 8 (P1). As a result, the locking surface 14 may end up too far away form the upper joint edge 8, so that a play exists between two joined boards.

The problem which the present invention aims primarily to solve is the above-illustrated problem of compound tolerances (t1+t2). When the tolerances of the gripping stud 24 are added to the manufacturing tolerances of the strip 10 and the strip/board positioning tolerances, the total tolerance becomes too high and the quality of the system is reduced. If the distance between the upper joint edge 8 and the locking surface 14 is too great, the finished joint will have a gap that is too large. If the same distance is too small, the boards cannot be joined together.

As will be seen from the description below, other advantages in terms of production, in addition to the elimination of the above-mentioned problem of compound tolerances, are achieved by the present invention.

In order to solve the aforementioned problems, the invention provides a method according to claim 1 as well as equipment according to claim 15, preferred embodiments being stated in the dependent claims.

Thus, the invention provides a method and equipment for making building boards of the type comprising a body fitted with a locking device in the form of a strip extended from the body with a formed locking surface for mechanical joining of the boards, the strip and the locking surface being formed in one piece from a blank. The invention is characterised by carrying out the following steps A and B in optional order:

A. forming the locking surface against a forming surface and then keeping the locking surface thus formed fixed relative to the forming surface until the two steps A and B have been carried out, B. attaching the strip to the body, and by, during the implementation of the latter of the steps A and B, keeping the body fixed against a reference surface, whose position relative to the forming surface corresponds to a desired position of the locking surface relative to the body.

Within the scope of the above definition of the invention, there are a number of embodiments, which all achieve the desired accuracy of the distance between the locking surface and the body. In every case, the invention is characterised in that the strip never is both formed with its locking surface and attached to the body prior to positioning the locking surface and the body correctly in relation to each other with the aid of the forming surface and the reference surface. Regardless of the order in which the steps A and B are carried out, the aforementioned problem of compound tolerances is eliminated.

According to the definition of the invention, when the locking surface has been formed, the strip is never handled as a completely separate unit during the manufacturing process and, preferably, nor is the strip handled as a separate unit before the locking surface is formed.

Using a store of separate, preformed and/or unformed strips entails undesired handling and positioning problems. The strip, with or without a formed locking surface, should always be fixed in relation to at least one of the forming surface, the body, and the blank.

In order to implement the invention, the strip is preferably mechanically attached to the body, but gluing is also possible. Preferably, the strip is mechanically attached by bending certain parts of the strip round a gripping stud formed in the body, for example as disclosed in WO 94/26999.

According to a preferred embodiment of the invention, the blank is gradually fed forward and is subsequently divided for separating the strip from a subsequent part of the blank, which is gradually fed forward during a subsequent cycle. Preferably, the blank is not divided until the strip has been fixed in relation to the forming surface and/or has been attached to the body.

The forming surface and the reference surface preferably constitute two surfaces in one and the same pressing or punching tool.

According to a first alternative, the strip is attached to the body before the locking surface is formed against the forming surface. In this case, it is possible to attach the strip at a different location and subsequently arrange the body with the attached strip in a forming tool for forming the locking surface, while holding the body fixed against said reference surface. However, it is preferred to carry out the attaching and forming in one and the same tool without intermediate handling of the strip and the body.

According to another alternative, the locking surface is formed against the forming surface before the strip is attached to the body, the formed locking surface being held fixed relative to the forming surface until the attachment step has been carried out.

According to a particularly preferred embodiment, the locking surface is formed against the forming surface and the strip is attached to the body in one single reciprocating punching operation of a punching tool common to these two steps. In this case, no handling of the strip and the body is required between the steps A and B. The forming and the attaching can be effected essentially simultaneously, but, preferably, the strip is attached to the body somewhat prior to the forming of the locking surface.

The body exhibits an edge portion which, in the case of mechanical joining of the board to a second board, lies in the immediate vicinity of the second board. The step of fixing the body against the reference surface preferably comprises positioning and fixing this edge portion against said reference surface, whose position in relation to the forming surface corresponds to a desired position of the locking surface in relation to said edge portion. Other portions of the body are also possible, but might provide an inferior final result because of tolerance problems.

To sum up, the inventions affords, inter alia, the following advantages: A building board of the type in question, for example in the form of a floorboard, of e.g. 1200*200 mm, can, on one long side as well as on one short side, be provided with a formed and attached strip a) in one single manufacturing operation, b) in a continuous process, c) with a very short cycle time of about 2 s, and d) within tolerances of ±0.01 mm between the locking surface and the joint edge despite the fact that, in practice, the manufacturing tolerances are considerably larger. In general, in manufacturing, it is desirable to be able to work with the largest possible tolerances, since this reduces set-up and take-down times, checks, and tool grinding.

The aforementioned as well as other embodiments and advantages can be seen from the claims and the description hereinbelow of a preferred embodiment of the invention.

DESCRIPTION OF AN EMBODIMENT

Figure 1:
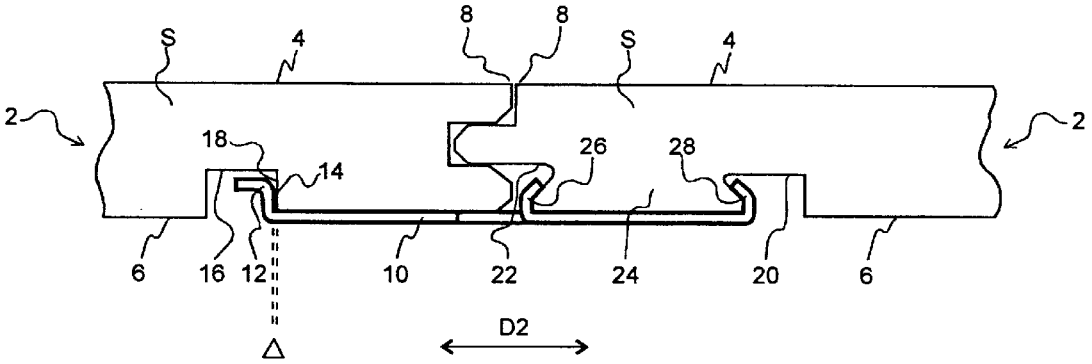
FIG. 1 shows in section two mechanically joined edge portions of two identical floorboards.
Figure 2:
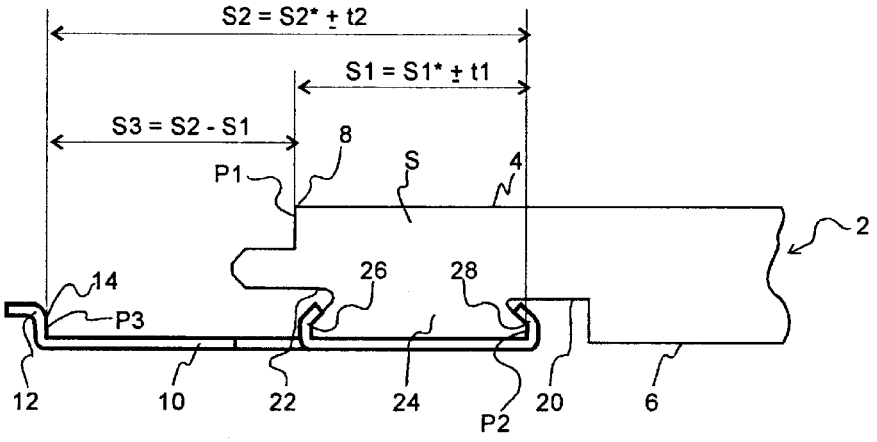
FIG. 2 illustrates certain distances and tolerances of one of the edge portions in FIG. 1.

A preferred embodiment of a production line for making a floorboard according to FIG. 1 in accordance with the invention will now be described with reference to FIGS. 3–5 in the appended drawings. The same reference symbols as in FIGS. 1 and 2 will be used for the components of the floorboard.

Figure 3:
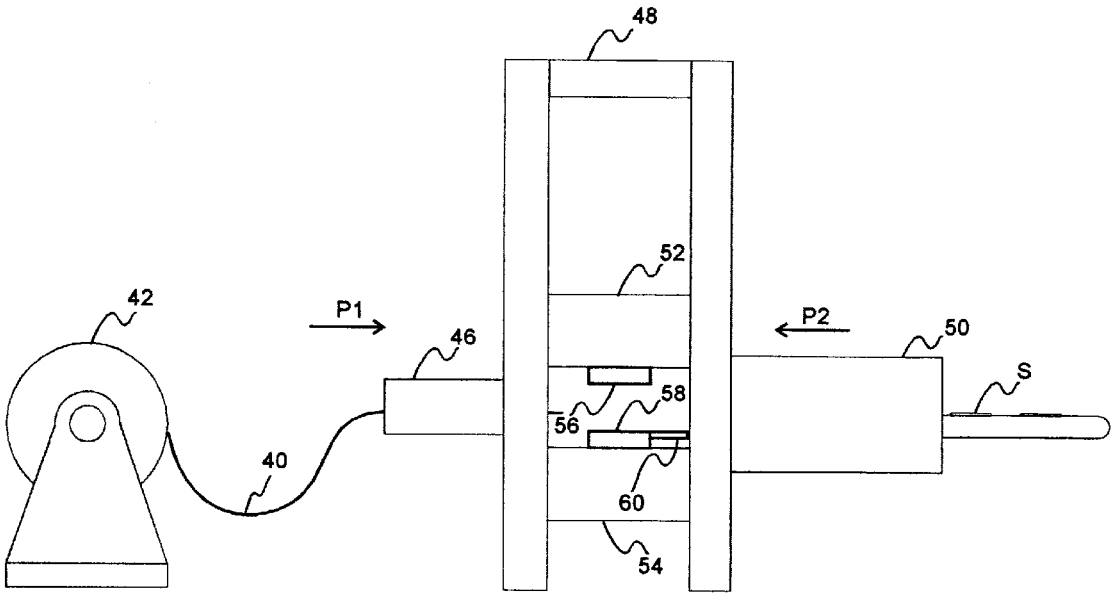
FIG. 3 is an overall view of a production line for making floorboards according to the invention.

In FIG. 3, a flexible, formable blank 40, preferably sheet aluminium, is wound onto a reel 42. The aluminium sheet 40 is fed from the reel 42 to a sheet feeder 46. The task of the sheet feeder 46 is to gradually feed (arrow P1) the flat blank 40 into a press 48. On its opposite side, the press 48 (arrow P2) receives machined (milled) bodies S of e.g. compact laminate from a board feeder 50.

In the production line in FIG. 3, the blank 40 is cut into separate metal strips 10, locking elements 12 are formed in the strips 10, and the strips 10 are mechanically attached to board bodies S. As mentioned above, and as will be explained in more detail below, the order of these operations may vary within the scope of the invention. The resulting building boards exhibit very good tolerance values with respect to the position of the locking element 12 in relation to the board body S.

Figure 4:
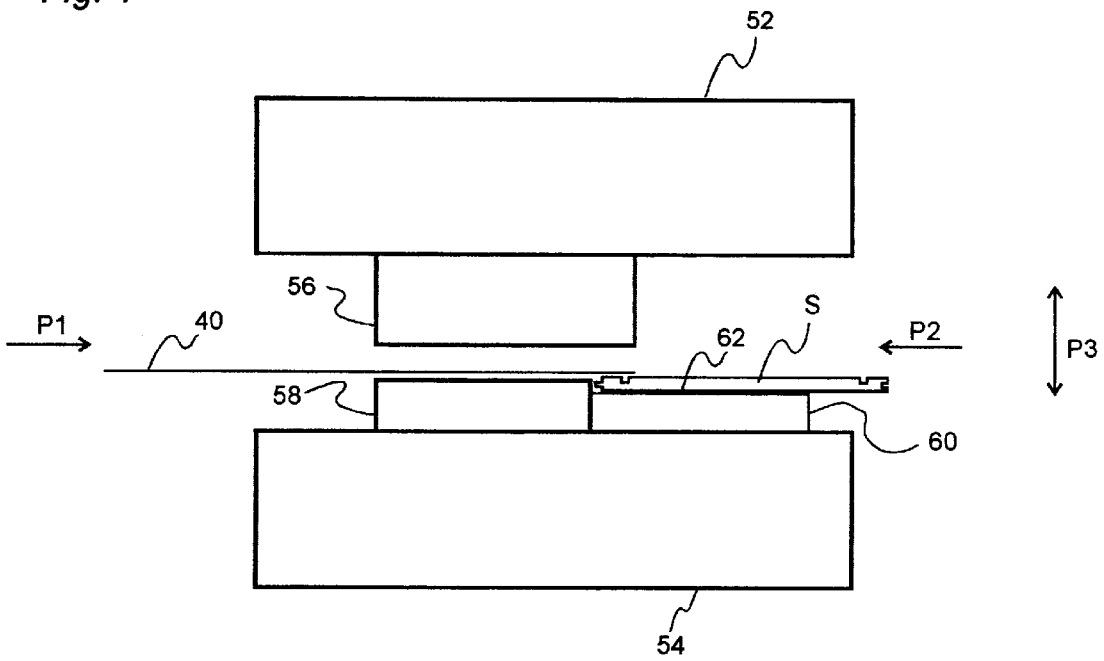
FIG. 4 shows the central portion of a press forming part of the production line in FIG. 3.

FIG. 4 schematically shows a central part of the press 48. An upper press table 52 supports a punch holder 56, and a lower press table 54 supports an associated die cushion 58 as well as a tool table 60 adjacent to the die cushion 58, which table forms an upper support surface 62 (see FIG. 5) for the body S. The two press tables 52 and 54 are movable in relation to each other in the direction indicated by the arrow P3.

Figure 5A:
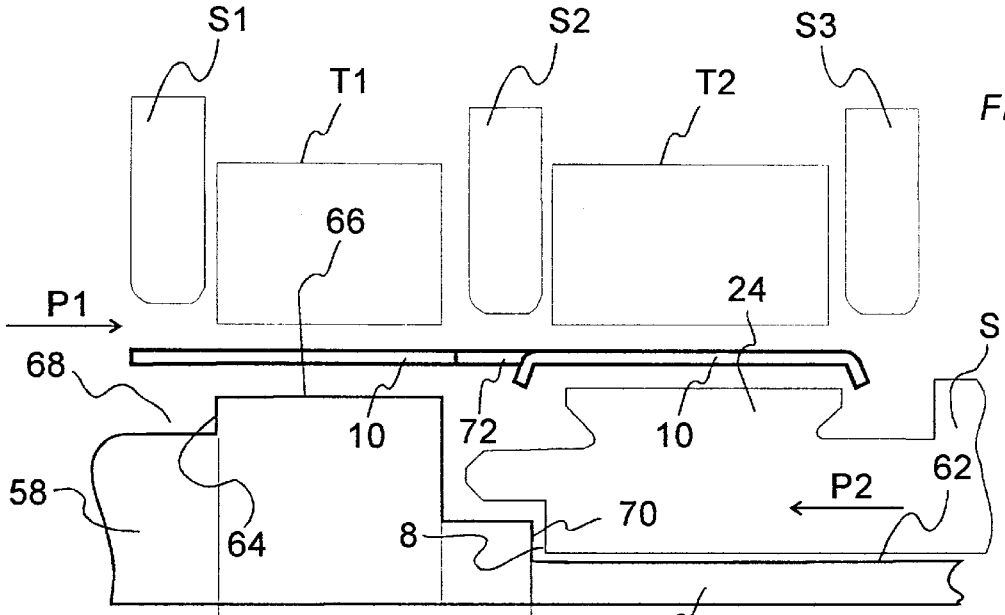
FIGS. 5A–5C show three consecutive operational steps in an operating cycle of the press in FIG. 4.
Figure 5B:
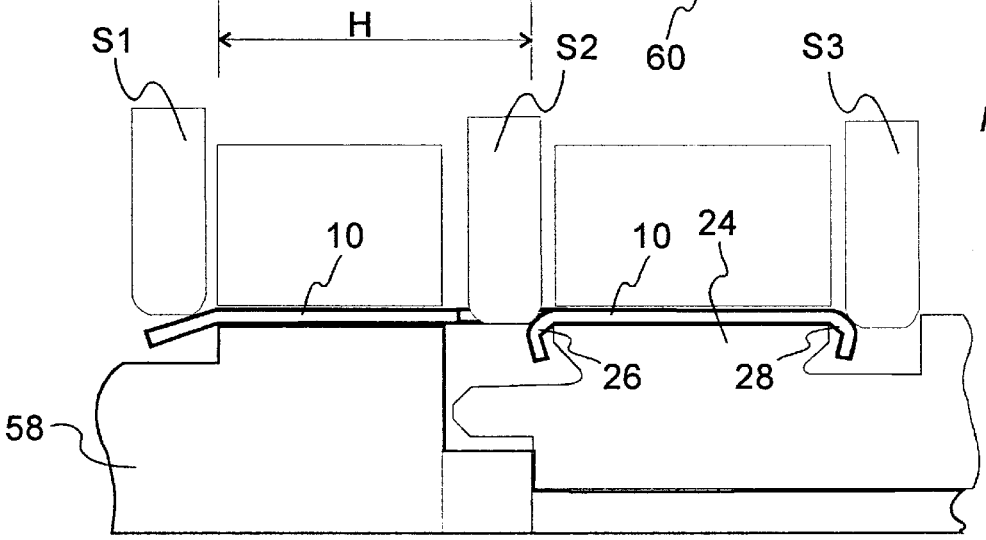
Figure 5C:
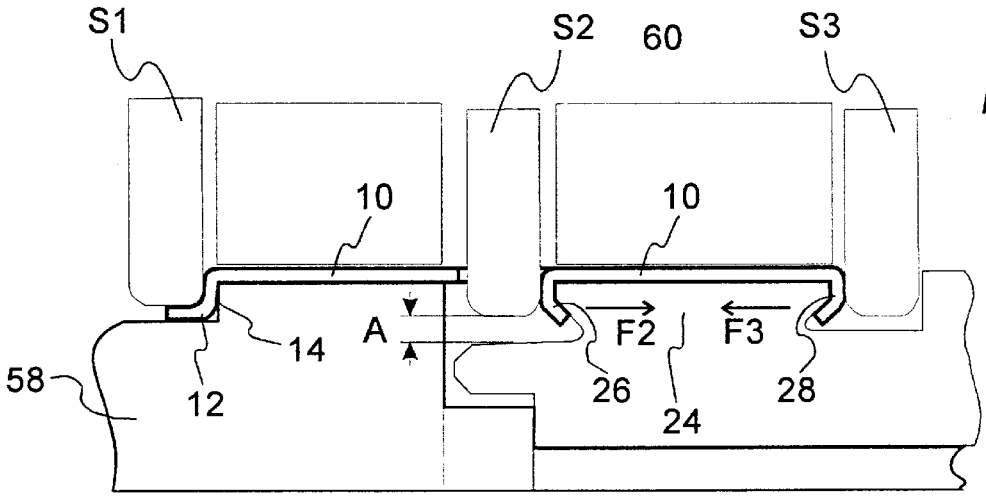

FIGS. 5A–C (which are generally referred to as FIG. 5) show the parts which are central to (i) the forming of the locking element 12 of the strip 10 and (ii) the attachment of the strip 10 to the body S.

FIG. 5 shows the die cushion 58 and the tool table 60 on a larger scale. Since these two parts can be manufactured with very great accuracy (negligible tolerance) they can be considered as an integrated part from a functional point of view.

In its top side, the die cushion 58 has a forming surface 64 against which the locking element 12 of the strip 10 is formed, as well as a holding surface 66. The forming surface 64 is formed by two part surfaces of a groove 68 formed with great precision in the die cushion 58 and extending perpendicular to the plane of the drawing along the entire width of the blank 40. The tool table 60 has a stop edge 70 which extends transversely of the insertion direction P2 and against which a predetermined portion of the body S is caused to abut when the body S is fed into the press 48. In the preferred embodiment, said predetermined portion consists of the upper joint edge B of the body S. The task of the stop edge 70 is to serve as a reference surface and, for this purpose, it has an exact, predetermined position in relation to the forming surface 64 corresponding to a desired position of the upper joint edge 8 of the body S in relation to the locking surface 14. The distance H in FIG. 5 is thus equal to a desired value S3* of the distance S3 indicated in FIG. 2. The forming surface 64 and the reference surface 70 together function as a "template" against which the locking surface 14 and the upper joint edge 8, respectively, are positioned for achieving good tolerance values in the finished building board.

Three punches 71, 72, and 73 are shown above the die cushion 58 and the tool table 60. In the embodiment shown, these punches operate in unison in relation to the die cushion 58. Moreover, two vertically movable holding-down means 74 and 75, separate from the punches 71–73, are shown. The punches 71–73 and the holding-down means 74 and 75 are extended over the entire width of the blank 40. However, 72 is constructed from a plurality of mutually separate modules.

The first punch 71 forms the locking surface 14 of the locking element 12 against the forming surface 64. The second punch 72 and the third punch 73 serve to bend the tongues 26 and the lip 28, respectively, round the gripping stud 24 of the body S in order mechanically to attach the strip 10 to the body S. As mentioned above, the second punch 72 is constructed from modules, each module serving to bend a corresponding tongue 26 and having a width of e.g. 10 mm. To enable the punch 71 to carry out the bending of the lip 28, the latter is preformed in the blank 40 upstream in the production line, and to enable the punch 72 to carry out the bending of the tongues 26, the latter are preformed in the blank 40 upstream in the production line, so that there are openings 76 in the blank 40 for receiving the second punch 72.

An operating cycle of the press described above will now be described in more detail. First, the part of the blank 40 which is to form the strip 10 is gradually fed over the die cushion 58. During this feeding, the lip 28 and the tongues 26 are preformed and the strip 10 is still formed in one piece with the rest of the blank 40. A certain partial separation may nevertheless have taken place earlier, but in any case, in this feeding step, the strip 10 is not handled as a separate unit. Substantially simultaneously, a body S is fed (P2) over the tool table 60 and is positioned with its upper joint edge 8 abutting against the reference surface 70.

Subsequently, the holding-down means 74 and 75 are activated to the holding position shown in FIG. 5B. The holding-down means 74 fixes the strip 10 relative to the die cushion 58. The holding-down means 75 fixes the strip 10 relative to the underside 6 of the body S and fixes the body S relative to the tool table 60 and, consequently, also relative to the reference surface 70. The holding-down means 74 and 75 are maintained in this holding position until the locking element 12 has been formed and the strip 10 has been fastened to the body S.

In the next step, the punches 71–73 are activated in unison according to FIGS. 5B and 5C, so that (i) the locking surface 14 of the locking element 12 is formed against the forming surface 64, (ii) the strip 10 is separated from the blank 40 by being cut off with e.g. a punch, and (iii) the strip 10 is fastened to the body S. These three operations thus take place substantially simultaneously. In order to ensure that the punch 71 "bottoms" against the groove 68, the punches 72 and 73 move somewhat ahead of the punch 71. In this way, subsequent to completing their bending of the tongues 24 and the lip 28, the punches 72 and 73 can continue an extra distance during the final forming of the locking element 12 by means of the punch 71. All punching operations (cutting, forming, bending) are finished when the punch 71 reaches its bottom position against the forming surface 64.

Using presently available technology, the die cushion 58 and the tool table 60 can be manufactured with very great accuracy (tolerance in the order of 0.001 mm). The distance H, which represents the relative position of the forming surface 64 and the reference surface 70 and which is equal to the desired value S3* for the critical distance S3 between the upper joint edge 8 of the floorboard and the locking surface 14 of the locking element 12, can thus be considered exact without tolerances.

When present-day punching technology is used for forming the locking element 12, a tolerance t3 in the order of 0.01 mm occurs. This tolerance t3 is a great deal better than the tolerance which occurs when the body S is machined (0.02–0.03 mm). In addition, machining tools wear more than punching tools, which means that, in practice, the dimensional accuracy when machining the body S can amount to ±0.05 mm. The effect of this latter tolerance is eliminated by the invention.

When the locking surface 14 is formed against the forming surface 64, the above-mentioned tolerance t3 arises with respect to the relative position of the locking surface 14 and the forming surface 64.

Locking surface 14

$\xleftrightarrow{t3}$

Forming surface 64 (1)

Moreover, according to the above, the forming surface 64 and the reference surface 70 have an exact relative position:

Forming surface 64

$\xleftrightarrow{\text{Exact}}$

Reference surface 70 (2)

(1)+(2) equates to the position of the formed locking surface 14 relative to the reference surface 70 also being determined with the tolerance t3:

Locking surface 14

$\xleftrightarrow{t3}$

Reference surface 70 (3)

Since the holding-down means 74 holds the strip 10 fixed in relation to the die cushion 58 and, consequently, in relation to the reference surface 70 during the entire punching operation of the punches 71–73, the relation (3) is fulfilled as long as the holding-down means 74 is activated. The relative position of the locking surface 14 and the reference surface 70 is thus determined with great accuracy (tolerance t3).

The upper joint edge 8 of the body S can be exactly positioned in relation to the reference surface 70 with essentially no tolerance, i.e.:

Reference surface 70

$\xleftrightarrow{\text{exact}}$

Upper joint edge 8 (4)

The exact position of the upper joint edge 8 in relation to the reference surface 70 is fixed with the aid of the second holding-down means 75, which also fixes the strip 10 in relation to the body S. The relation (4) is thus fulfilled during the entire punching operation of the punches 71–73. (3)+(4) equates to the position of the formed locking surface 14 in relation to the upper joint edge 8 in this instance being determined with tolerance t3:

Locking surface 14

$\xleftrightarrow{t3}$

Upper joint edge 8 (5)

Since the strip 10 is constantly held fixed in relation to the body S with the aid of the holding-down means 75, the above-mentioned relation (5) is riot affected by the mechanical fastening of the joint to the body S. The desired relation (5) can be achieved regardless of whether the strip 10 is attached to the body S somewhat prior to or somewhat subsequent to the forming of the locking element 12.

To sum up, the problem of compound tolerances is eliminated, since the tolerances with respect to the machining of the body S do not influence the final result. The critical distance S3 can be determined with an accuracy t3 based on S3=S3*±t3 (=H±t3).

In addition to the elimination of the problem of compound tolerances, another problem is also solved in the above embodiment: The strip 10 is not separated from the blank 40 until the holding-down means 74 and 75 have been activated. By virtue of the fact that the blank 40 and, consequently, the future strip 10 can be fed by means of the sheet feeder 46 in exact feeding increments, the not yet separated strip 10 can be positioned with great accuracy in relation to both the gripping stud 24 and the punches 72 and 73.

In the embodiment described above, pre-bending is carried out of the tongues 26 and of the lip 28. This pre-bending is preferred, but is not required per se for the implementation of the invention and, in a simpler variant, could be omitted in the above embodiment.

Prior to positioning and fixing the strip with the aid of the holding-down means 74 and 57, the tongues 26 as well as the lip 28 are pre-bent to the position shown in FIG. 5A. The pre-bending-of the tongues 26 as well as the lip 28 is achieved in prior manufacturing steps (not shown). The pre-bending is carried out along a line spaced from the gripping stud 24. When the punches 72 and 73 are activated (FIGS. 5B and 5C), a second bending takes place round the gripping stud 24. In this connection, the pre-bent portion will undergo a certain reverse bending, resulting in a bias arising in the tongues 26 as well as in the lip 28. This bias affords, inter alia, the following important advantages:

The body S, which is typically made of wood or a wood-based material, or of plastic, may change its dimensions in connection with variations in moisture and temperature, while the metal strip is temperature-sensitive only. The biasing ensures that such dimensional changes of the body and/or the strip do not have a negative impact on the mechanical connection.

Since the forming of the locking element 12 is carried out by a punch operating vertically and the fastening can be carried out with the same punching tool, it is advantageous if the fastening can be effected with the punches operating vertically. The pre-bending technique makes this possible.

The pre-bending means that the thickness of the body and, consequently, of the finished floorboard can be reduced, since the depth of the recesses 20 and 22 in the underside 6 of the body S can be reduced.

An inaccurate position of the gripping stud 24 is compensated for by the fact that the tongues and the lip can be reverse bent to different degrees.

Since the lip 28 extends continuously along the entire length of the strip 10, while the tongues 26 are disposed at a distance from each other in the longitudinal direction of the strip 10, the pressure on the lip 28 exerted by the punch 73 will be greater than the pressure on the tongues 26 exerted by the punch 72. The horizontal force F3 generated by the punch 73 (FIG. 5C) will thus be greater than the opposed force F2 exerted the punch 52. The effect of this force differential (F3−F2) is that a possible "banana shape" of the body S, which could give rise to an undesired gap in the joint between two interconnected boards, is straightened out.

What is claimed is:

1. A method for making a building board, the building board comprising a body fitted with a locking device in the form of a strip extending from the body with a formed locking surface for mechanical joining of the board to similar boards, the strip and the locking surface being formed in one piece from a blank, wherein said method comprises the following steps A and B in optional order:

A. forming the locking surface against a forming surface and subsequently keeping the locking surface thus formed fixed in relation to the forming surface until both step A and step B have been carried out, B. attaching the strip to the body, and, while carrying out the latter of steps A and B, the method further comprises the step of keeping the body fixed against a reference surface, whose position in relation to the forming surface corresponds to a desired position of the locking surface in relation to the body.

2. The method as claimed in claim 1, wherein the body is held fixed against the reference surface during the completion of step A as well as step B.

3. The method as claimed in claim 1, wherein the body is positioned and fixed against the reference surface subsequent to the completion of the first of steps A and B.

4. The method as claimed in claim 1, wherein the strip is never handled as a separate unit during the manufacturing of the building board, but rather is always fixed in relation to at least one of the forming surface, the body, and the blank.

5. The method as claimed in claim 1, wherein the strip is mechanically attached to the body.

6. The method as claimed in claim 5, wherein the strip is mechanically attached to the body by certain parts of the strip being bent round a gripping stud formed in the body.

7. The method as claimed in claim 1, wherein the blank is gradually fed forward and is subsequently divided for separating the strip from a subsequent part of the blank, which is gradually fed forward during a subsequent cycle.

8. The method as claimed in claim 7, wherein the blank is not divided until the strip has been fixed in relation to the forming surface and/or has been attached to the body.

9. The method as claimed in claim 7, wherein the blank is preformed prior to being gradually fed forward and, as a result of this incremental feeding, is positioned in relation to the body.

10. The method as claimed in claim 1, wherein the forming surface and the reference surface constitute surfaces in one and the same punching tool, preferably two surfaces in one and the same die cushion.

11. The method as claimed in claim 1, wherein the strip is attached to the body before the locking surface is formed against the forming surface.

12. The method as claimed in claim 1, wherein the locking surface is formed against the forming surface before the strip is attached to the body.

13. The method as claimed in claim 1, wherein the locking surface is formed against the forming surface and the strip is attached to the body during one single reciprocating punching operation of a common punching tool for these two operations.

14. The method as claimed in claim 1, wherein the body exhibits an edge portion which in connection with mechanical joining is disposed in the immediate vicinity of a second board, and wherein the step of fixing the body against the reference surface comprises positioning and fixing said edge portion against the reference surface, whose position in relation to the forming surface corresponds to a desired position of the locking surface in relation to said edge portion.

15. The method as claimed in claim 8, wherein the blank is preformed prior to being gradually fed forward and, as a result of this incremental feeding, is positioned in relation to the body.

* * * * *